US010184308B2

(12) United States Patent
Chauffe et al.

(10) Patent No.: US 10,184,308 B2
(45) Date of Patent: Jan. 22, 2019

(54) METHOD AND APPARATUS FOR DOWNHOLE TOOL ACTUATION

(71) Applicant: TEAM Oil Tools, LP, The Woodlands, TX (US)

(72) Inventors: Stephen J. Chauffe, The Woodlands, TX (US); Michael J. Harris, Houston, TX (US); Kenneth J. Anton, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 196 days.

(21) Appl. No.: 15/114,433

(22) PCT Filed: Jan. 27, 2015

(86) PCT No.: PCT/US2015/013120
§ 371 (c)(1),
(2) Date: Jul. 27, 2016

(87) PCT Pub. No.: WO2015/116597
PCT Pub. Date: Aug. 6, 2015

(65) Prior Publication Data

US 2016/0340993 A1 Nov. 24, 2016

Related U.S. Application Data

(60) Provisional application No. 61/392,344, filed on Jan. 28, 2014.

(51) Int. Cl.
*E21B 34/14* (2006.01)
*E21B 23/04* (2006.01)
(Continued)

(52) U.S. Cl.
CPC ..... *E21B 23/04* (2013.01); *E21B 34/063* (2013.01); *E21B 34/103* (2013.01); *E21B 34/14* (2013.01);
(Continued)

(58) Field of Classification Search
CPC ..... E21B 23/04; E21B 34/063; E21B 34/103; E21B 34/14; E21B 47/12; E21B 47/122;
(Continued)

(56) References Cited

U.S. PATENT DOCUMENTS

2010/0110833 A1 5/2010 Close
2010/0134112 A1* 6/2010 Zhang ..... G01V 3/28 324/339
(Continued)

FOREIGN PATENT DOCUMENTS

WO 00-02330 A1 1/2000

*Primary Examiner* — Yong-Suk Ro
(74) *Attorney, Agent, or Firm* — MH2 Technology Law Group LLP

(57) ABSTRACT

A downhole tool and a method for operating the downhole tool, in which the downhole tool includes a first sensing member, and a second sensing member. The first and second sensing members have a first communication status when the downhole tool is in a first configuration. The first and second sensing members have a second communication status that is different from the first communication status when the downhole tool is in a second configuration. The downhole tool is prevented from actuating prior to the first and second sensing members having the second communication status, and the downhole tool is permitted to actuate after the first and second members have the second communication status.

21 Claims, 5 Drawing Sheets

(51) Int. Cl.

| | |
|---|---|
| ***E21B 47/12*** | (2012.01) |
| ***E21B 34/06*** | (2006.01) |
| ***E21B 34/10*** | (2006.01) |
| *E21B 33/10* | (2006.01) |
| *E21B 34/00* | (2006.01) |

(52) U.S. Cl.
CPC ..... *E21B 47/12* (2013.01); *E21B 47/122* (2013.01); *E21B 33/10* (2013.01); *E21B 47/123* (2013.01); *E21B 2034/007* (2013.01)

(58) Field of Classification Search
CPC ... E21B 33/10; E21B 47/123; E21B 2034/007
See application file for complete search history.

(56) References Cited

U.S. PATENT DOCUMENTS

| | | | | |
|---|---|---|---|---|
| 2010/0200295 | A1 | 8/2010 | Schimanski et al. | |
| 2013/0070817 | A1 | 3/2013 | McCormack et al. | |
| 2013/0087321 | A1* | 4/2013 | Bartko ..... | E21B 43/26 166/66 |
| 2014/0000909 | A1 | 1/2014 | Neer | |
| 2014/0352981 | A1* | 12/2014 | Fripp ..... | E21B 41/0085 166/381 |

* cited by examiner

METHOD AND APPARATUS FOR DOWNHOLE TOOL ACTUATION

CROSS REFERENCE TO RELATED APPLICATIONS

This application is a U.S. National Stage application of PCT/US2015/013120, filed on Jan. 27, 2015, which claims priority to U.S. Provisional Patent Application Ser. No. 61/932,344, which was filed on Jan. 28, 2014, the contents of which are hereby incorporated by reference in their entirety.

BACKGROUND

Downhole tools, i.e., tools that are run into a wellbore as part of a tubular string, are sometimes actuated in the wellbore. For example, a downhole tool may include a valve to be opened, a seal to be expanded, a sleeve to be moved, etc., at a certain time or location in the wellbore.

Some methods of actuation include surface pipe manipulation, which generally includes picking up string weight, slacking off string weight, and/or string rotation. Other methods include pressure actuation, by which varying the hydraulic pressure experienced by the downhole tool actuates the tool. Pressure actuation has become one of the more common actuation methods; however, in some cases, a tool may be configured to withstand a burst pressure test of the tubular string, without actuating. Accordingly, to actuate the tool, a second pressure, in excess of the level used in the burst pressure test, may be applied. As such, a higher than tested pressure may be applied to the tubular string, which may pose a risk to the integrity of the tubular string.

SUMMARY

Embodiments of the disclosure may provide a downhole tool. The downhole tool includes a first sensing member, and a second sensing member. The first and second sensing members have a first communication status when the downhole tool is in a first configuration, and the first and second sensing members have a second communication status that is different from the first communication status when the downhole tool is in a second configuration. The downhole tool is prevented from actuating prior to the first and second sensing members having the second communication status, and the downhole tool is permitted to actuate after the first and second members have the second communication status.

Embodiments of the disclosure may also provide a downhole tool. The downhole tool includes a substantially cylindrical body defining an axial bore formed at least partially therethrough, a first annulus positioned radially-outward from the bore, and a first port providing a path of fluid communication between the bore and at least a portion of the first annulus. The downhole tool also includes a first sleeve positioned within the first annulus and configured to move in response to pressure received through the first port, and a first sensing member coupled to the first sleeve. The downhole tool further includes a second sensing member coupled to the body. The first and second sensing members are positioned sufficiently far apart from one another such that the first and second sensing members are not able to communicate with one another when the downhole tool is in a first configuration. The first and second sensing members are positioned close enough together such that the first and second sensing members are able to communicate with one another when the downhole tool is in a second configuration. The downhole tool is prevented from actuating prior to the downhole tool being in the second configuration at least once, and the downhole tool is permitted to actuate after being in the second configuration at least once.

Embodiments of the disclosure may further provide a method. The method may include running a downhole tool into a wellbore in a first configuration. The downhole tool includes a first sensing member and a second sensing member. The first sensing member and the second sensing member have a first communication status when the downhole tool is in the first configuration. The method may also include increasing a pressure in the wellbore to a first pressure after running the downhole tool into the wellbore. Increasing the pressure in the wellbore causes the downhole tool to move into a second configuration. The first sensing member and the second sensing member have a second communication status when the downhole tool is in the second configuration.

The foregoing summary introduces some aspects of the present disclosure. The summary is not an exhaustive overview, nor is it intended to identify key or critical elements to delineate the scope of the subject matter claimed below.

BRIEF DESCRIPTION OF THE DRAWINGS

Embodiments of the present disclosure may be understood by reference to the following description taken in conjunction with the accompanying drawings. In the figures.

DETAILED DESCRIPTION

Figure 1:
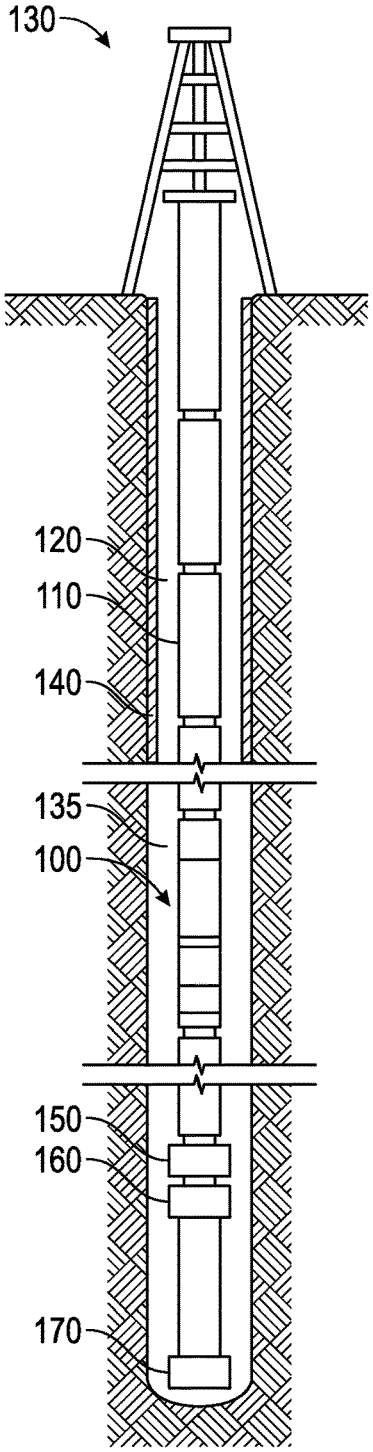
FIG. 1 depicts a schematic view of a tubular string in a wellbore, where the tubular string has a downhole tool attached thereto, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

Embodiments of the disclosure may provide a downhole tool configured to be disposed in a wellbore. The downhole tool includes two sensing members that are selectively allowed to communicate. The downhole tool may also include an actuator, which actuates the downhole tool responsive to the communication (or lack thereof) between the two sensing members. One technology for the implementation of the two sensing members is radio frequency identification or "RFID." However, other technologies may be suitable in various embodiments. In at least some embodiments, the actuation of the tool may not require the retrieval or drill-up of a seat or profile.

Turning now to the specifically illustrated embodiment, FIG. 1 depicts a downhole tool 100 deployed as a part of a tubular string 110 in a wellbore 120, e.g., as part of a well completion 130 for cementing operations. The cementing operation may involve delivery of fluids from the interior of the tubular string 110 to the exterior 135 of the tubular string 110 within the wellbore 120. The downhole tool 100 may be run on a liner, a casing, a tubing, or any other string or pressure bearing pipe, as part of the tubular string 110, lowered into the wellbore 120. Furthermore, although this particular embodiment is intended for a cementing operation, embodiments of the downhole tool 100 may be used in other applications as well.

The well completion 130 may be configured for any type of wellbore operation, including any type of cementing operation. For example, the well completion 130 may include a casing 140 that ends at a predetermined point above the bottom of the wellbore 120. The portion of the wellbore 120 below the casing 140 is referred to as "open hole." In some embodiments, however, the casing 140 may extend to the distal end of the wellbore.

The downhole tool 100 may be disposed toward the distal end of the tubular string 110. The downhole tool 100 may be, for example, three or four (or more or less) joints from the bottom of the casing 140 or the tubular string 110. The joints below the downhole tool 100 may include, but are not limited to, a landing collar 150, a float collar 160, a float shoe 170, or some combination of these depending on the embodiment.

As they are used herein, the terms "upper" and "lower" identify that which is closer and farther, respectively, or proximal and distal, respectively, to the Earth's surface in accordance with their usage in the art. The same is true for similar terms such as "uphole" and "downhole" when used in such a context. Thus, in embodiments where the wellbore 120 is horizontal and the components are not necessarily "above" or "below" each other in the sense one might find in a vertical wellbore, they will still be proximal or distal to the surface and no the terms "upper", "lower", "uphole", and "downhole" still apply. Thus, although the embodiment shown in FIG. 1 is a vertical wellbore 120, it will be appreciated that embodiments of the present disclosure are equally applicable to deviated and horizontal wellbores.

Figure 2:
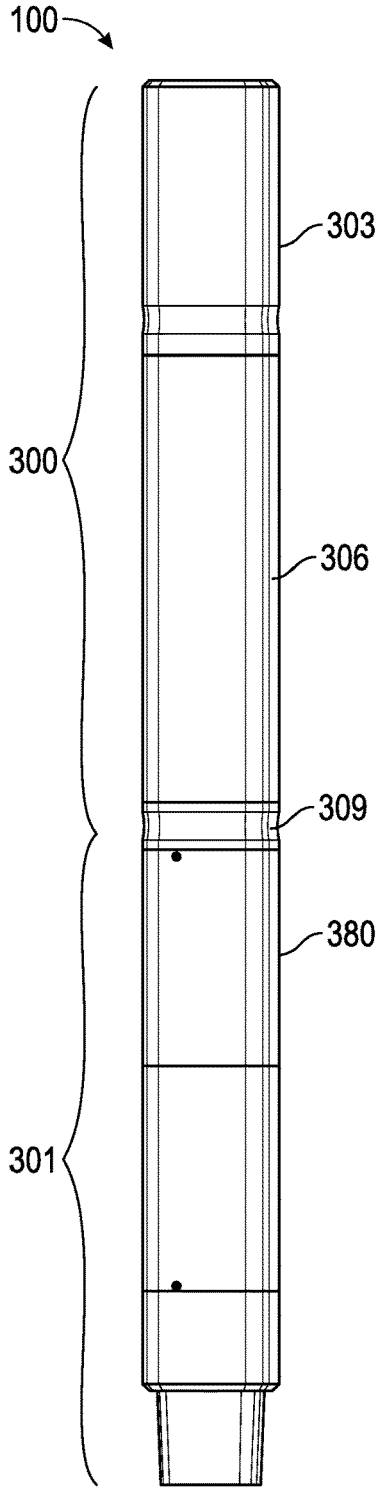
FIGS. 2 and 3 depict a side view and a side cross-sectional view of the downhole tool, respectively, in a first (e.g., run-in) position, according to an embodiment.
Figure 3:
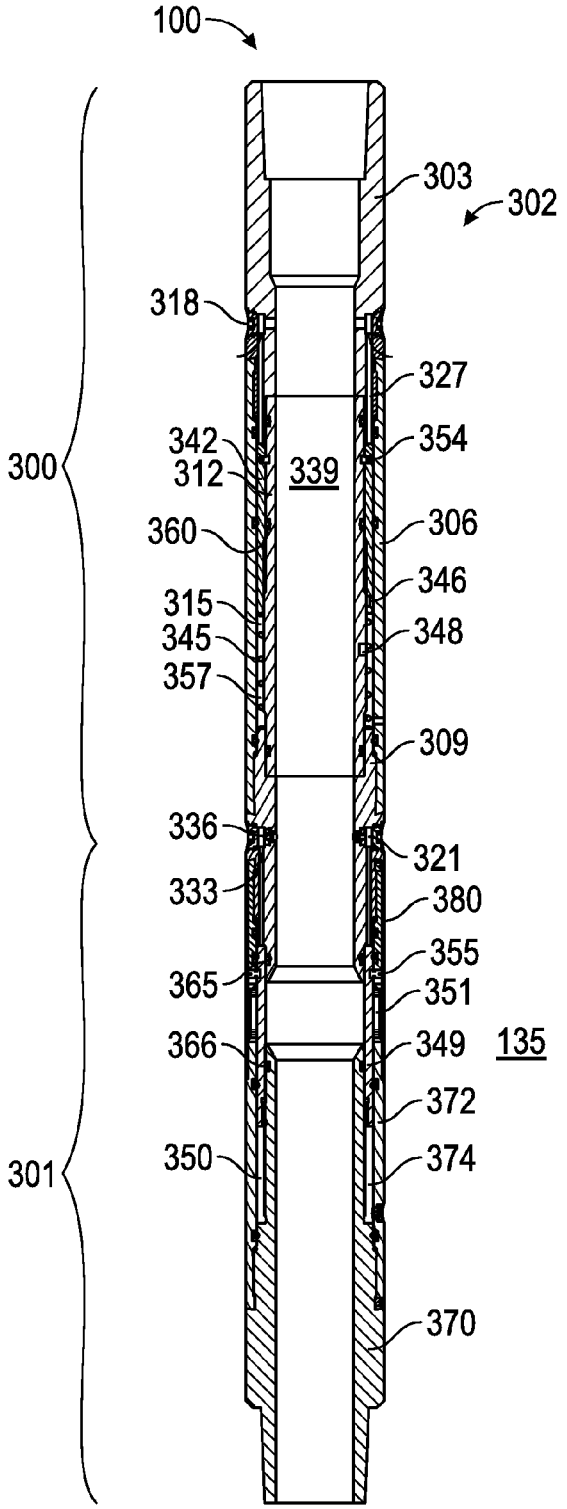

FIGS. 2 and 3 depict a side view and aside cross-sectional view of the downhole tool 100, respectively, in a first (e.g., run-in) position, according to an embodiment. The downhole tool 100 may include a first portion 300 and a second portion 301. The first portion 300 may be configured to determine when to actuate the downhole tool 100, e.g., responsive to pressures in the tubular string 120 (Figure)), while the second portion 301 may be the part of the downhole tool 100 that is actuated. In a specific embodiment, the second portion 301 may provide a toe valve, but in other embodiments, other types of valves, tools, etc. may be provided. Details of the determination of when to actuate, and the actuation of the downhole tool 100 are provided below, according to an embodiment.

Referring now to FIG. 3, the first portion 300 of the downhole tool 100 includes a substantially cylindrical body 302 having an axial bore 339 formed at least partially therethrough. The body 302 may also include an upper sub 303, an upper housing 306, and a coupling 309. The housing 306 is mechanically engaged at the ends thereof to the upper sub 303 and the coupling 309. The illustrated embodiment effects the mechanical engagement through mating threads. However, other suitable coupling devices and/or methods may be employed in other embodiments.

The body 302 in the illustrated embodiment also includes an inner mandrel 312 disposed within the upper housing 306 and axially between the upper sub 303 and the coupling 309. The inner mandrel 312 abuts the upper sub 303 and the coupling 309 on either end, but may be spaced apart therefrom. Further, the inner mandrel 312 and the upper housing 306 define an annulus 315 radially therebetween. An upper portion 327 of the annulus 315 is in fluid communication with a first port 318 in the upper sub 303. The first port 318, in turn, communicates with the bore 339. Although two first ports 318 are shown, any number of first ports 318 may be provided.

A first sleeve 342 may be disposed in the annulus 315, and may be configured to move, e.g., axially, therein with respect to the inner mandrel 312 and/or the upper housing 306. Such movement may be responsive to fluid pressure in the bore 339, applied to the upper portion 327 of the annulus 315 and to the first sleeve 342 via the first ports 318. A lower portion 357 of the annulus 315 may be sealed from the upper portion 327 via seals 360, such that a pressure increase in the upper portion 327 results in a pressure differential across the first sleeve 342. The first sleeve 342 may be pinned to the inner mandrel 312 by a shear pin 354 (or another mechanism) to prevent inadvertent shifting.

A biasing member (e.g., a spring) 345 is also disposed within the annulus 315. The biasing member 345 may engage the coupling 309 and the first sleeve 342, so as to bias the first sleeve 342 in an uphole direction. In other embodiments, the biasing member 345 may be disposed between the upper sub 303 and the first sleeve 342 and/or may bias the first sleeve 342 in a downhole direction.

A first sensing member 346 may be coupled to the first sleeve 342, and a second sensing member 348 may be coupled to the inner mandrel 312. For example, the first sensing member 346 may be positioned within a recess in the first sleeve 342 or embedded in the first sleeve 342, and the second sensing member 346 may be positioned within a recess in the inner mandrel 312 or embedded in the inner mandrel 312. In another embodiment, the first and second sensing members 346, 348 may be strapped or otherwise affixed to the first sleeve 342 and the inner mandrel 312, respectively. Further, in some embodiments, the first sensing member 346 may be coupled to the upper housing 306, rather than the first sleeve 342, such that the first sleeve 342 slides between the first and second sensing members 346, 348 to selectively obstruct communication therebetween.

The first sensing member 346 may be a transmitter and the second sensing member 348 may be a receiver. However, in other embodiments, the first sensing member 346 may be a receiver and the second sensing member 348 may be a transmitter. The first sensing member 346 and second sensing member 348 may operate on any kind of communication technology known to the art, such as optical, magnetic, electrical, or other types of communication technology. In the illustrated embodiment, the first and second sensing members 346, 348 operate using radio frequency technology. In particular, the first and second sensing members 346, 348 may communicate with one another using radio frequency identification ("RFD") transmitters and receivers when they are in close proximity to one another.

Corresponding RFID transmitters and receivers may operate using a unique identification code to avoid cross-talk with other RFID transmitters and receivers in close proximity. Furthermore, in some embodiments, multiple transmitter/receiver combinations may be provided in the same tool. Thus, the various transmitters may employ unique identifiers to avoid cross-talk amongst transmitter/receiver pairs and errors in operation.

In an embodiment, the first and second sensing members 346, 348 may have a first communication status when the downhole tool 100 is in a first configuration (e.g., during run-in), and a second communication status when the downhole tool 100 is in a second configuration. For example, the first sensing member 346 and second sensing member 348 may be positioned far enough apart during run-in to prevent the first and second sensing members 246, 348 from communicating with one another. This distance may be implementation-specific dependent upon the particular embodiment of the first sensing member 346 and second sensing member 348. In other embodiments, the first and second sensing members 346, 348 may be in communication during run-in, and may be moved out of communication upon movement of the first sleeve 342. In still other embodiments, one or more additional sensing members may be provided, which may be in or out of communication with another sensing member prior to actuation, e.g., to provide redundancy as to the configuration of the position of the downhole tool 100.

The illustrated embodiment hosts the first sensing member 346 and second sensing member 348 on the first portion 300 of the downhole tool 100, which is separate from the second portion 301. However, embodiments are contemplated in which the first sensing member 346 and/or second sensing member 348 are placed directly upon the second portion 301 (e.g., any relatively movable components thereof, as will be described in greater detail below).

Referring to both FIG. 2 and FIG. 3, the second portion 30) of the downhole tool 100 may be a toe valve. In the illustrated embodiment, the second portion 301 may be or be similar to the toe valve disclosed in U.S. application Ser. No. 13/924,828, which is incorporated by reference herein in its entirety. However, it is to be understood that other suitable downhole tools, whether hydraulically-actuated or actuated using other methods, may be used.

In an embodiment, the second portion 301 of the downhole tool 100 includes an annulus 350 formed between a lower sub 370 and a third sleeve 372, and between the coupling 309 and the third sleeve 372. The coupling 309 and the lower sub 370 are spaced axially apart so as to define one or more ports 351 therebetween, which may extend from the bore 339, through the third sleeve 372, and to the exterior of the downhole tool 100. The third sleeve 372 may connect together the lower sub 370 and the coupling 309. The second sleeve 349 may be disposed in the annulus 350 and spans the ports 351, prior to actuation of the downhole tool 100, so as to prevent communication through the ports 351. A portion 374 of the annulus 350 below the second sleeve 349 may be sealed against pressure fluctuations in the bore 339 by one or more sealing elements 366, while the annulus 350 above the second sleeve 349 may be sealed by one or more sealing elements 365.

The second sleeve 349 may be movably disposed in the annulus 350, and, at least initially, may be held in place by one or more sheer pins 355 (or another mechanism). A pressure from the bore 339 communicates with the annulus 350, e.g., an upper portion 333 thereof and then to the second sleeve 349, via one or more second ports 321. With the lower portion 374 being sealed, such pressure fluctuations in the upper portion 333 may result in a pressure differential across the second sleeve 349.

The second ports 321 may extend through the coupling 309. A pressure barrier 336, such as a rupture disk, check valve, poppet valve, or another valve may obstruct fluid communication in each of the second ports 321. The pressure barrier 336 may, for example, be coupled with and/or disposed in the coupling 309. In other embodiments, the pressure barrier 336 may be disposed in another location.

The bore 339 in the downhole tool 100 may be at a hydrostatic pressure as the downhole tool 100 is run into the wellbore 120. The downhole tool 100 is shown in its first or run-in position in FIG. 3. The second sleeve 349 is in a closed position, preventing fluid flow from the bore 339, through the ports 351, and to the exterior 135 of the tubular string 110 (FIG. 1).

The illustrated embodiment also includes an optional shroud 380, shown in FIG. 2. The shroud 380 covers the ports 351 during deployment and operations to help prevent the ports 351 from fouling. The shroud 380 may also manage pressure in the bore 339. The shroud 380 may be designed to fall away during operations upon experiencing some particular pressure. For example, when the wellbore 120 is pressured up to the first pressure, the shroud 380 may fall away to leave the ports 351 unobstructed but for the second sleeve 349. Again, some embodiments may omit the shroud 380.

In operation, the downhole tool 100 may begin in a first configuration, which is shown in FIG. 3, when it is run into the wellbore 120 (FIG. 1). In the first configuration, the first sensing member 346 and second sensing member 348 have the first communication status, e.g., they may be unable to communicate with one another. The wellbore 120 is then pressured up to a first pressure (e.g., by a pump at the surface). This increase in pressure is communicated to the first sleeve 342 through the first port 318, creating a pressure differential across the first sleeve 342. The second sleeve 349, however, is not moved by this increased pressure, because pressure barriers 336 in the second ports 321 may prevent communication to the upper portion 333 of the annulus 350.

Figure 4:
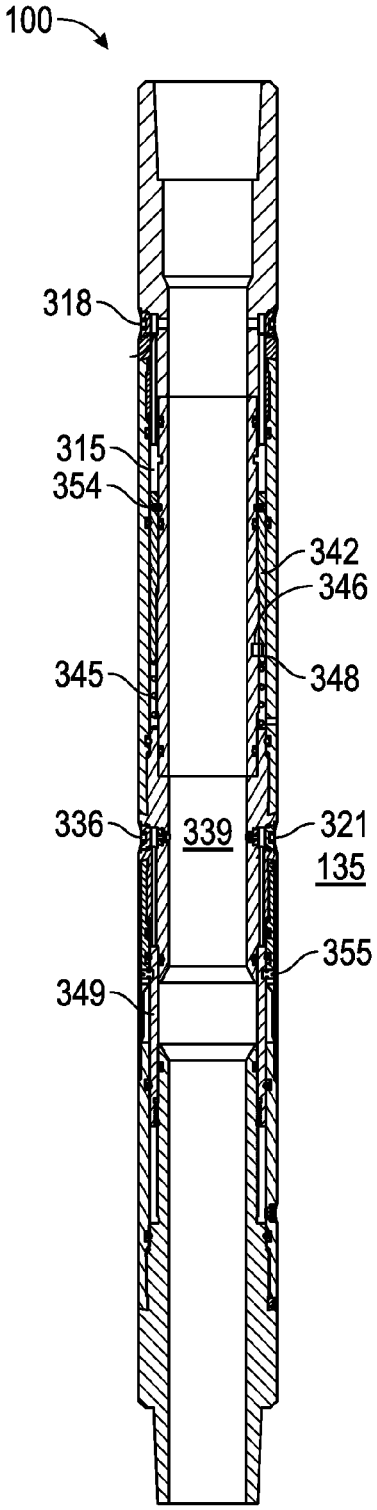
FIG. 4 depicts a side cross-sectional view of the downhole tool in a second configuration, according to an embodiment.
Figure 5:
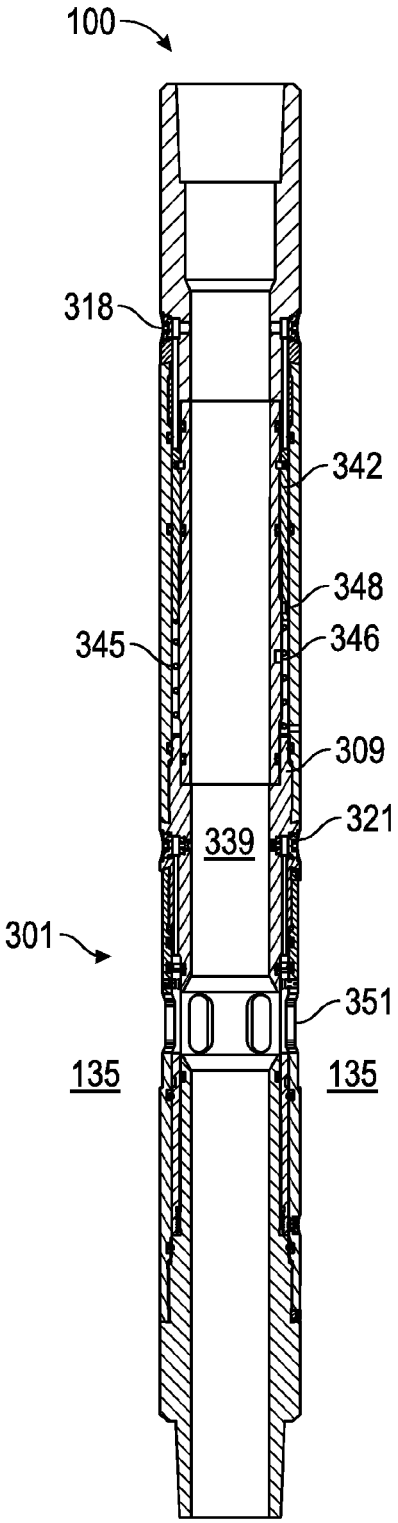
FIG. 5 depicts a side cross-sectional view of the downhole tool in a third configuration, according to an embodiment.

Turning now to FIG. 4, when the wellbore 120 reaches the first pressure, the pin 354 shears, permitting movement of the first sleeve 342. This pressure is also great enough to overcome the opposing force of the biasing member 345. When the pin 354 shears and the biasing member 345 is overcome, the first sleeve 342 shifts downward within the annulus 315, as shown in FIG. 4. This downward stroke, responsive to the fluid pressure in the bore 339, causes the first and second sensing members 346, 348 to have the second communication status. For example, the movement of the first sleeve 342 may align (e.g., axially) the first sensing member 346 and second sensing member 348 sufficiently so that they can communicate with one another. The second sleeve 349 remains in its closed position because it is isolated from the increased pressure by the pressure barrier 336. This may be referred to as the "second configuration" of the downhole tool 100, in which the communication status of the first and second sensing members 346, 348 is changed (e.g., from non-communicable to communicable, or vice versa).

In the second configuration, the alignment of the first sensing member 346 and second sensing member 348 in the illustrated embodiment is such that neither may be considered uphole or downhole from the other. However, in some embodiments, the first sensing member 346 and the second sensing member 348 may be "aligned" while one is slightly uphole of the other. As mentioned above, when the tubular string 110 is run into the wellbore 120, the first sensing member 346 and second sensing member 348 are unaligned in that they are outside of each other's operational ranges such that they cannot communicate. Thus, to "align" the first sensing member 346 and the second sensing member 348, as used in this context means to bring one or the other of them into the operational range of the other so that they can effectively communicate. Furthermore, axial translation may not be needed for such alignment; rather, components (e.g., the inner mandrel 312 and/or first sleeve 342) upon which the first and second sensing members 346, 348 are attached may be relatively rotatable. Thus, when not in communication, the first and the second sensing members 346, 348 may be circumferentially offset and, when in communication, the first and second sensing members 346, 348 may be circumferentially aligned. In other embodiments, the first and second sensing members 346, 348 may be moved both circumferentially and axially into and/or out of communication with one another.

The change in communication status of the first sensing member 346 and the second sensing member 348 may trigger a condition that allows a pressure, which may be a second pressure that is lower than the first pressure, to move the second sleeve 349 to an open position. In at least one embodiment, the condition may be the barrier 336 being weakened or otherwise adjusted such that the pressurized fluid in the wellbore 120 may flow through the second port 321 and cause the second sleeve 349 to slide downward into an open position, so that it no longer blocks or obstructs the port 351. When the second sleeve 349 is in the open position, the downhole tool 100 is in the "third configuration."

As such, the downhole tool 100 may be considered to include an actuator, which may include the barrier 336, the second sleeve 349, and/or any other component(s) that may assist in the downhole tool 100 changing its configuration in the wellbore, such that a pressure in the bore 339 is able to move the second sleeve 349. The actuator is in communication with at least one of the first and second sensing members 346, 348, whether electrical (wireless or wired), magnetic, pneumatic, hydraulic, mechanical, or another type of communication, such that the actuator is responsive to whether the first and second sensing members 346, 348 are in communication with one another. In an embodiment, the actuator may also include one or more microprocessors, which may be disposed in the downhole tool 100, or at the top surface of the wellbore, which may receive signals from the first and/or second sensing members 346, 348 and trigger the condition. Accordingly, the actuator may trigger the condition in response to the first and second sensing members 346, 348 being able to communicate, or not being able to communicate with one another, via, e.g., the movement of the first sleeve 342.

In an embodiment, the condition may be triggered when the first and second sensing members 346, 348 are able to communicate for the first time. In another embodiment, the condition may be triggered when communication between the first and second sensing members 346, 348 ceases or terminates. In other embodiments, the communication ability between the first and second sensing members 346, 348 may come and go. For example, the first sleeve 342 may move back and forth to move the first and second sensing members 346, 348 into and out of range with one another several times. In another example, the sensing members 346, 348 may be stationary (e.g., coupled with the inner mandrel 312 and the upper housing 306, respectively) and the first sleeve 342 (or anther communication-disrupting member) may move between the sensing members 346, 348 and may interrupt communication between the first and second sensing members 346, 348 at select times. The number of times that the sensing members 346, 348 are able to communicate with one another may be counted, or otherwise change communications status, and the condition may be triggered after a predetermined number of times, which may be greater than one (e.g., three times).

In some embodiments, the actuator may trigger the condition after the pressure is relieved on the downhole tool, e.g., after the burst test is complete. For example, the actuator may not trigger the condition until after the first and second sensing members 346, 348 are no longer in communication with one another.

In one example, the barrier 336 is a rupture disk, and the actuator may cause an electrical current to run through the barrier 336 that causes the barrier 336 to rupture. The current may be provided by a battery located, for example, in the downhole tool 100. In another example, the barrier 336 may be a ball or gate valve, or another type of valve. As such, the actuator may cause a signal to be transmitted to the valve of the barrier 336, which may cause the valve to open. In another embodiment, the condition may include sending a signal to a solenoid, a motor, or the like in the body 302 that, in response to the signal, moves the second sleeve 349 into the open position. In an embodiment, the solenoid may fracture or weaken the barrier 336 such that pressure in the bore 339 ruptures the barrier 336. In yet another embodiment, the second sleeve 349 may be held in the closed position by a component (e.g., a fiber, such as a KEVLAR® fiber). The condition may be heating the fiber until the fiber weakens or melts, allowing the second sleeve 349 to move into the open position. In another embodiment, the condition may be causing a valve to open (or close), so as to apply a pneumatic or hydraulic pressure to the second sleeve 349, the disk 336, or another component. Accordingly, the downhole tool 100 may be actuated in response to pressure in the bore 339, without the pressure being applied directly to the second sleeve 349 and/or without the slidable first sleeve 342 engaging the second sleeve 349.

In another embodiment, the actuator may include a battery and a mechanical or electrical, or electromechanical, switch. When the first and second sensing members 346, 348 are aligned, for example, the switch may be thrown, causing the condition to be triggered. For example, the switch may be physically engaged and thrown by movement of the first sleeve 342. Alternatively, when the first and second sensing members 346, 348 are aligned, the first sleeve 342 may complete a circuit with the actuator, causing the condition to be triggered. With the circuit closed, the battery supply a current, which may cause the condition, e.g., weakening the barrier 339, melting the fiber, opening the valve, etc. It will be appreciated that the above-described actuators and conditions are just a few among many contemplated herein.

After the condition is triggered, the pressure of the fluid in the wellbore 120 may then be lowered and/or brought to a second pressure sufficient to shear the pin 355 and move the second sleeve 349 downward. When the second sleeve 349 strokes downward, it no longer obstructs the ports 351 in the downhole tool 100 as shown. In this third configuration of the downhole tool 100, fluid is permitted to flow from the bore 339 to the exterior 135 of the tubular string 110.

In other embodiments, the second sleeve 349 may stroke downwards in response to the first pressure, and thus the application of the second pressure may be omitted. In some embodiments, however, the actuator may respond to the second application of pressure, rather than the first application of pressure, since the first application may be a burst pressure test. The second pressure may cause the first and second sensing members 346, 348 to come into communication (or out of communication) a second time, which may result in the actuator allowing pressure to communicate to the second sleeve 349, as described above.

Accordingly, in these embodiments, the second sleeve 349 is permitted to move (as an example of "actuation" of the downhole tool 100) after the condition is triggered. The condition is triggered after the communication status between the first and second sensing members 346, 348 changes at least once. The second sleeve 349 may be prevented from moving to the open position before such condition is triggered. Although described above with reference to a sleeve in a valve, it will be appreciated that the downhole tool 100 may include any other type of actuating member.

Figure 6:
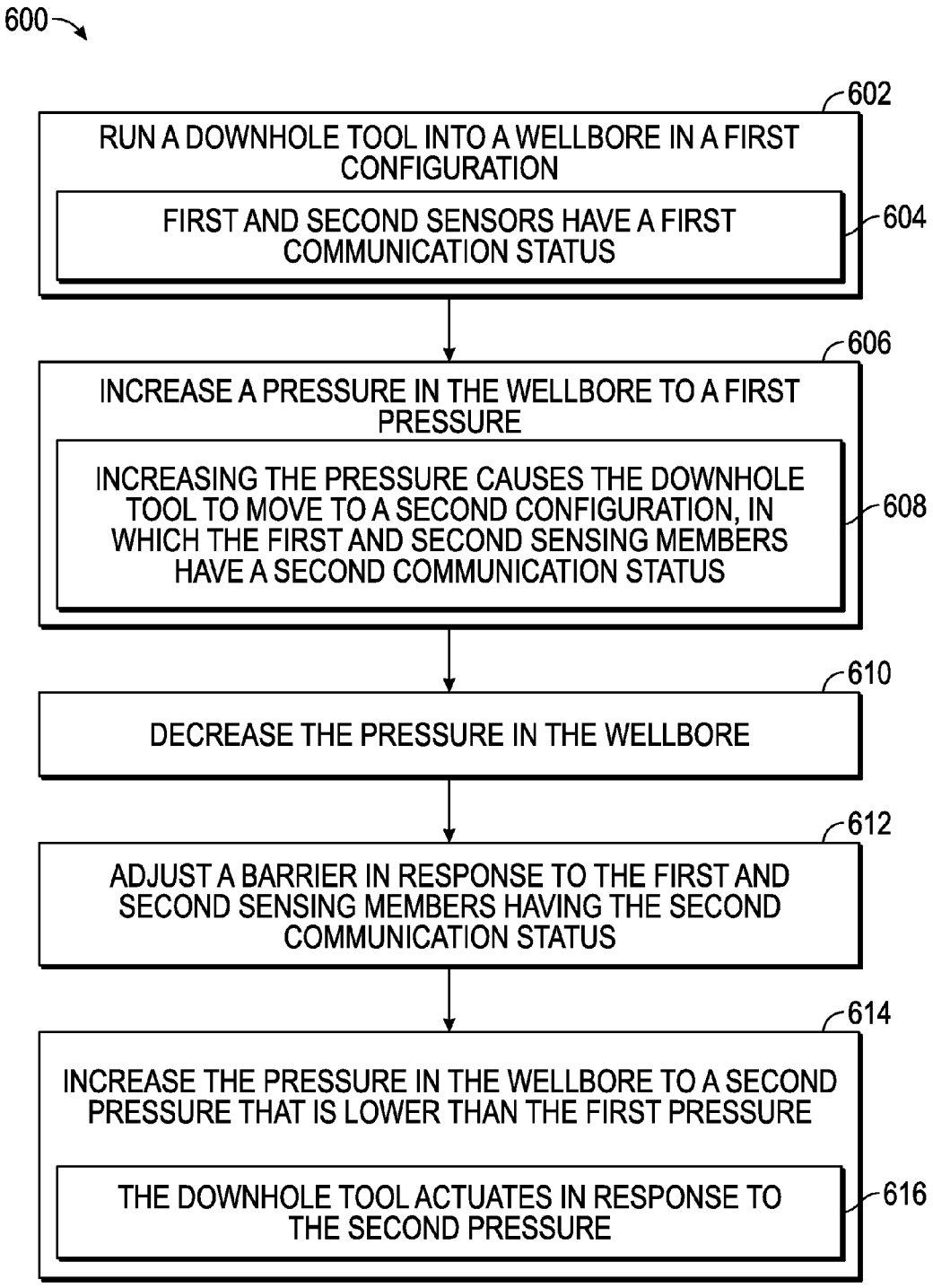
FIG. 6 depicts a flowchart of a method for actuating the downhole tool, according to an embodiment.

FIG. 6 depicts a flowchart of a method 600 for actuating the downhole tool 100, according to an embodiment. The method 600 may proceed by operation of an embodiment of the downhole tool 100, for example, and may thus be best understood with reference thereto. However, it will be appreciated that the method 600 is not limited to any particular structure unless otherwise stated herein. In addition, the aspects of the method 600 below may be conducted in any order, and the order described below is for illustrative purposes only.

The method 600 may include running a downhole tool into a wellbore in a first configuration, as at 602. The downhole tool includes a first sensing member and a second sensing member. In the first configuration, e.g., as the tool is run into the wellbore, the first sensing member and the second sensing member may have a first communication status, as indicated at 604. The first communication status may be that the first and second sensing members are able to communicate or that they are not able to communicate.

The method 600 may also include increasing a pressure in the wellbore to a first pressure, as at 606, e.g., after running the downhole tool into the wellbore. Increasing the pressure in the wellbore may cause the downhole tool to move into a second configuration, in which the first sensing member and the second sensing member have a second communication status, as indicated at 608. The second communication status may be different from the first communication status. For example, if the first communication status is that the first and second sensing members are not able to communicate, the second communication status is that they are able to communicate.

In an embodiment, the downhole tool also includes a body and a first sleeve that is disposed in the body. In such an embodiment, increasing the pressure at 606 may cause the first sleeve to move and thereby move the downhole tool to the second configuration. Further, the first sensing member may be coupled to the first sleeve and may be aligned with the second sensing member when the first sleeve is moved.

In an embodiment, the method 600 may also include decreasing the pressure in the wellbore after increasing the pressure, as at 610. The downhole tool may also include a second sleeve that is slidable from a closed position in which the second sleeve prevents fluid flow through a port that extends between a bore of the body to an exterior of the body, to an open position in which the second sleeve permits fluid flow through the port. In such an embodiment, before, during, or after increasing the pressure at 610, the method 600 may further, and optionally, include adjusting a barrier in a port that communicates with the bore and the second sleeve in response to the first and second sensing members having the second communication status, as at 612.

The method 600 may further include increasing the pressure in the wellbore to a second pressure that is less than the first pressure, after decreasing the pressure, as at 614. The downhole tool may actuate in response to the second pressure, as at 616. For example, the second sleeve may move from the closed position to the open position in response to increasing the pressure in the wellbore to the second pressure at 616.

Figure 7:
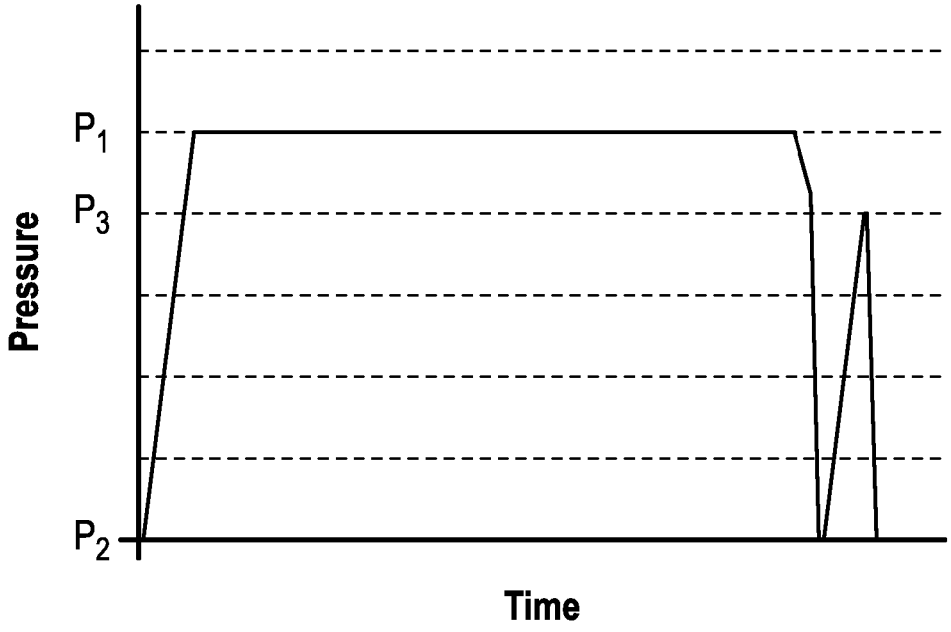
FIG. 7 depicts an example of a graph of pressure versus time for an embodiment of the downhole tool.

FIG. 7 illustrates a graph of pressure vs. time during the actuation of the downhole tool 100, according to an embodiment. The graph may describe a relationship of pressure vs. time in a toe-valve embodiment of the downhole tool 100; however, it will be appreciated that embodiments of the downhole tool 100 may provide a variety of other types of tools. Moreover, the graph may represent the pressure seen at the surface (e.g., at the pump that pumps fluid into the wellbore).

With additional reference to FIGS. 1-3, the pressure of the fluid in the bore 339 of the downhole tool 100 may increase and then level off at the first pressure $P_1$ at which the casing is to be tested. The downhole tool 100 may move from the first configuration (e.g., FIG. 1) to the second configuration (e.g., FIG. 2) during the pressure testing (e.g., at $P_1$). In an embodiment, the first and second sensing members 346, 348 may be moved into alignment (or otherwise change communication status) during the pressure testing at the first pressure $P_1$; however, the downhole tool 100 may be prevented from actuating. The pressure of the fluid may then decrease to a second pressure $P_2$. This may, for example, cause the first and second sensing members 346, 348 to move out of alignment (or otherwise again change communication status). In another embodiment, the first and second sensing members 346, 348 may remain in alignment at the second pressure $P_2$. Further, this may trigger the condition, e.g., such that the actuator causes the second sleeve 349 to be permitted to move in response to fluid pressure in the bore 339.

The pressure of the fluid may then be increased again to a third pressure $P_3$, which may be less than or equal to the first pressure $P_1$. The third pressure $P_3$ may or may not be sufficient to bring the first and second sensing members 346, 348 into alignment once again. However, the third pressure $P_3$ may be sufficient to actuate the downhole tool 100. The downhole tool 100 may thus actuate, or otherwise change configuration, such that, for example, the second sleeve 349 moves away from the ports 351 by application of the third fluid pressure $P_3$ and allows fluid communication therethrough. The pressure of the fluid may then remain at the third fluid pressure $P_3$, level off at a formation (injection) pressure, or decrease back to the hydrostatic pressure.

Those in the art will appreciate variations upon the particular embodiment disclosed above that still fall within the scope of the appended claims. For example, the technique may be used to actuate downhole tools other than toe valves. Furthermore, the valve and the tool it actuates may be manufactured as a single downhole tool rather than two separate tools. Or the technique of aligning the sensing member may be implemented such that one or both of the transmitter and receiver are disposed in, on, or upon the tool to be actuated. Still other variations will become apparent to those skilled in the art having the benefit of this disclosure.

What is claimed is:

1. A downhole tool, comprising:

a first sensing member; and a second sensing member, wherein the downhole tool being in a first configuration causes the first and second sensing members to have a first communication status, and wherein the downhole tool being in a second configuration causes the first and second sensing members to have a second communication status that is different from the first communication status, and wherein the downhole tool is prevented from actuating prior to the first and second sensing members having the second communication status, and the downhole tool is permitted to actuate after the first and second members have the second communication status.

2. The downhole tool of claim 1, further comprising a body, wherein the first sensing member and the second sensing member are positioned within the body.

3. The downhole tool of claim 2, further comprising a first sleeve movably positioned within the body and having the first sensing member coupled thereto, wherein the first sleeve moves so as to place the first and second sensing members into the second communication status in response to a first pressure in a bore of the body.

4. The downhole tool of claim 3, further comprising a second sleeve movably positioned in the body, wherein:

in a closed position, the second sleeve prevents fluid flow through a port extending between a bore of the body and an exterior of the body;

in an open position, the second sleeve does not prevent fluid flow through the port; and the second sleeve moves from the closed position to the open in response to a second pressure in the bore of the body that is less than the first pressure, the second pressure being applied to the downhole tool after the first pressure.

5. The downhole tool of claim 4, wherein the body defines:

a first port that provides a path of fluid communication from the bore to the first sleeve; and a second port that provides a path of fluid communication from the bore to the second sleeve.

6. The downhole tool of claim 5, further comprising a barrier positioned in the second port that prevents pressure from being transmitted from the bore to the second sleeve before the first and second sensing members have the second communication status, wherein the barrier allow the second pressure to be transmitted from the bore to the second sleeve after the first and second sensing members have the second communication status.

7. The downhole tool of claim 6, wherein the barrier comprises a rupture disk or a valve.

8. The downhole tool of claim 1, wherein the first sensing member is a transmitter and the second sensing member is a receiver.

9. The downhole tool of claim 1, wherein the first sensing member is a receiver and the second sensing member is a transmitter.

10. The downhole tool of claim 1, wherein the first and second sensing members employ radio frequency identification technology.

11. The downhole tool of claim 1, wherein the first communication status comprises the first and second sensing members not being able to communicate with one another, and the second communication status comprises the first and second sensing members being able to communicate with one another.

12. A downhole tool, comprising:

a substantially cylindrical body defining:

an axial bore formed at least partially therethrough;

a first annulus positioned radially-outward from the bore; and a first port providing a path of fluid communication between the bore and at least a portion of the first annulus;

a first sleeve positioned within the first annulus and configured to move in response to pressure received through the first port;

a first sensing member coupled to the first sleeve; and a second sensing member coupled to the body, wherein the first and second sensing members are positioned such that the downhole tool being in a first configuration prevents the first and second sensing members from communicating with one another, and the downhole tool being in a second configuration, in which the first and second sensing members are moved closer together, permits the first and second sensing members to communicate with one another, wherein the downhole tool is prevented from actuating prior to the downhole tool being in the second configuration at least once, and the downhole tool is permitted to actuate after being in the second configuration at least once.

13. The downhole tool of claim 12, wherein:

the body further defines a second annulus positioned radially-outward from the bore, and a second port providing a path of fluid communication between the bore and at least a portion of the second annulus; and the downhole tool further comprises a second sleeve positioned within the second annulus and configured to move in response to pressure received through the second port, wherein the downhole tool actuates by movement of at least the second sleeve.

14. The downhole tool of claim 13, further comprising a barrier positioned in the second port and configured to prevent the pressure from being communicated from the bore to the second sleeve when the downhole tool is in the first configuration.

15. The downhole tool of claim 14, wherein the barrier is configured to allow the pressure to be received by the second sleeve after the first and second sensing members communicate with one another.

16. The downhole tool of claim 15, wherein the body further defines a port between an exterior of the body and the bore, and wherein the second sleeve prevents fluid flow through the port at least when the barrier prevents the pressure from being communicated to the second sleeve.

17. A method, comprising:

running a downhole tool into a wellbore in a first configuration, the downhole tool comprising a first sensing member and a second sensing member, wherein the downhole tool being in the first configuration causes the first sensing member and the second sensing member to have a first communication status; and increasing a pressure in the wellbore to a first pressure after running the downhole tool into the wellbore, wherein increasing the pressure in the wellbore causes the downhole tool to move into a second configuration, wherein the downhole tool moving to the second configuration causes the first sensing member and the second sensing member to have a second communication status that is different from the first communication status.

18. The method of claim 17, wherein the downhole tool further comprises a body and a first sleeve that is disposed in the body, and wherein increasing the pressure causes the first sleeve to move and thereby move the downhole tool to the second configuration.

19. The method of claim 18, wherein the first sensing member is coupled to the first sleeve and is aligned with the second sensing member when the first sleeve is moved, wherein the first communication status is the first and second sensing members being prevented from communication with one another, and the second communication status is the first and second sensing members being communicable with one another.

20. The method of claim 18, wherein the downhole tool further comprises a second sleeve that is slidable from a closed position in which the second sleeve prevents fluid flow through a port that extends between a bore of the body to an exterior of the body, to an open position in which the second sleeve permits fluid flow through the port, the method further comprising adjusting a barrier in a port that communicates with the bore and the second sleeve in response to the first and second sensing members having the second communication status.

21. The method of claim 20, further comprising:

decreasing the pressure in the wellbore after increasing the pressure; and increasing the pressure in the wellbore to a second pressure that is less than the first pressure, after decreasing the pressure, wherein the second sleeve moves from the closed position to the open position in response to increasing the pressure in the wellbore to the second pressure.

* * * * *